US008176913B2

(12) United States Patent
Ivory

(10) Patent No.: US 8,176,913 B2
(45) Date of Patent: May 15, 2012

(54) RESPIRATOR HELMET WITH QUICK RELEASE SAFETY LENS

(75) Inventor: Garth Graham Ivory, Christchurch (NZ)

(73) Assignee: RPB Safety, LLC, Madison Heights, MI (US)

( * ) Notice: Subject to any disclaimer, the term of this patent is extended or adjusted under 35 U.S.C. 154(b) by 722 days.

(21) Appl. No.: 12/326,778

(22) Filed: Dec. 2, 2008

(65) Prior Publication Data

US 2010/0132703 A1 Jun. 3, 2010

(51) Int. Cl.
*A62B 17/04* (2006.01)

(52) U.S. Cl. ..... 128/201.24; 128/206.23; 128/857

(58) Field of Classification Search ..... 128/857, 128/858, 200.24, 201.12, 201.24, 206.23
See application file for complete search history.

(56) References Cited

U.S. PATENT DOCUMENTS

| | | | | | |
|---|---|---|---|---|---|
| 3,050,736 | A * | 8/1962 | Malcom, Jr. | 2/9 |
| 3,783,452 | A * | 1/1974 | Benson et al. | 2/6.4 |
| 4,028,743 | A * | 6/1977 | Christensen | 2/424 |
| 4,172,294 | A * | 10/1979 | Harris | 2/171.3 |
| 4,280,491 | A * | 7/1981 | Berg et al. | 128/201.24 |
| 4,926,854 | A * | 5/1990 | Bode | 128/201.23 |
| 5,671,483 | A * | 9/1997 | Reuber | 2/424 |
| 5,802,622 | A * | 9/1998 | Baharad et al. | 2/434 |
| 5,878,742 | A * | 3/1999 | Figueredo et al. | 128/201.24 |
| 7,003,802 | B2 * | 2/2006 | Broersma | 2/9 |
| 7,320,144 | B2 * | 1/2008 | Katz et al. | 2/9 |

* cited by examiner

*Primary Examiner* — Glenn Richman
(74) *Attorney, Agent, or Firm* — Blakely, Sokoloff, Taylor & Zafman LLP

(57) ABSTRACT

An apparatus including a lens, a gasket to receive the lens and a frame removably coupled to a respirator helmet is defined. The gasket forms a seal with a respirator helmet. The frame secures the lens within the gasket and defines a release mechanism to enable a quick release of the frame from the respirator helmet.

12 Claims, 4 Drawing Sheets

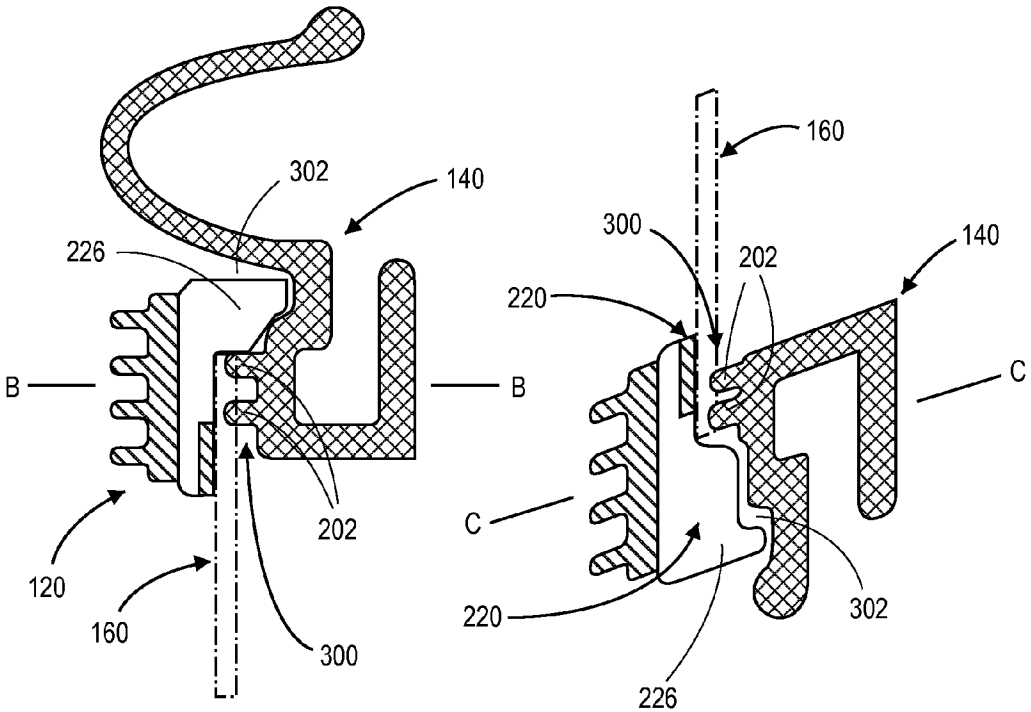
FIG. 3C
FIG. 3B
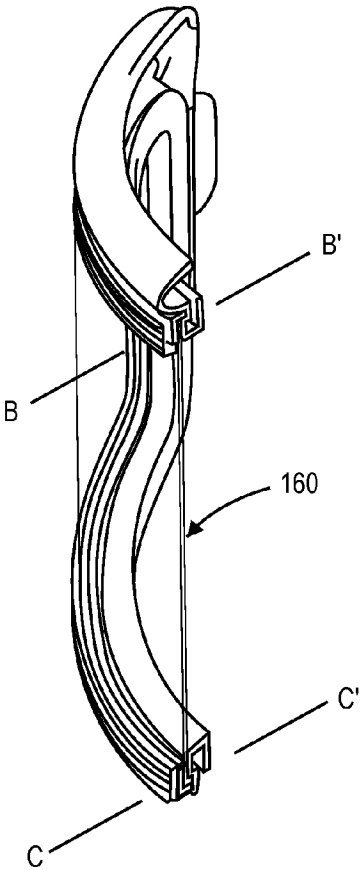
FIG. 3A

RESPIRATOR HELMET WITH QUICK RELEASE SAFETY LENS

BACKGROUND

1. Field of the Invention

Embodiments of the present invention relate to a respirator helmet. Specifically, the embodiments of the present invention relate to a respirator helmet including a lens securing mechanism, a lens release mechanism and an attachment mechanism to connect to an external respirator.

2. Description of the Related Art

Respirator helmets are worn to protect the wearer in a wide variety of environments. Some of these environments include steel industry locations, foundries, construction sites, mines, military bases and scientific laboratories. Steelworkers, constructions workers, miners, soldiers and lab technicians wear respiratory helmets to protect themselves from breathing in dust, harmful particulate matter or noxious gases. In some of these environments, it is also necessary for the wearers of helmets to have safety lenses on their helmets to protect their eyes from being hit by falling debris, projectiles, construction materials, hazardous chemicals or objects propelled by explosives, or ordinance.

Safety lenses are easily smeared, occluded or damaged by debris, chemicals and foreign objects and it is very difficult to clean them while the respirator helmet is being worn. Once lenses equipped to respirator helmets get smeared, occluded or damaged, the productivity of the wearer is diminished or halted until the lens is cleaned or replaced. Swapping or removing respirator helmet lenses has typically been time consuming and a somewhat difficult process. Historically the lens has required special tools and significant dexterity to remove or replace. Unfortunately, safety lenses are often not installed because users choose not to undertake the difficult replacement process. As a result such users are exposed to greater and unnecessary risk of injuries related to lens failures.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

FIGS. 3 A-C are diagrams of a cross-sectional view of one embodiment of a lens release mechanism, a lens securing mechanism and a lens.

DETAILED DESCRIPTION

Figure 1A:
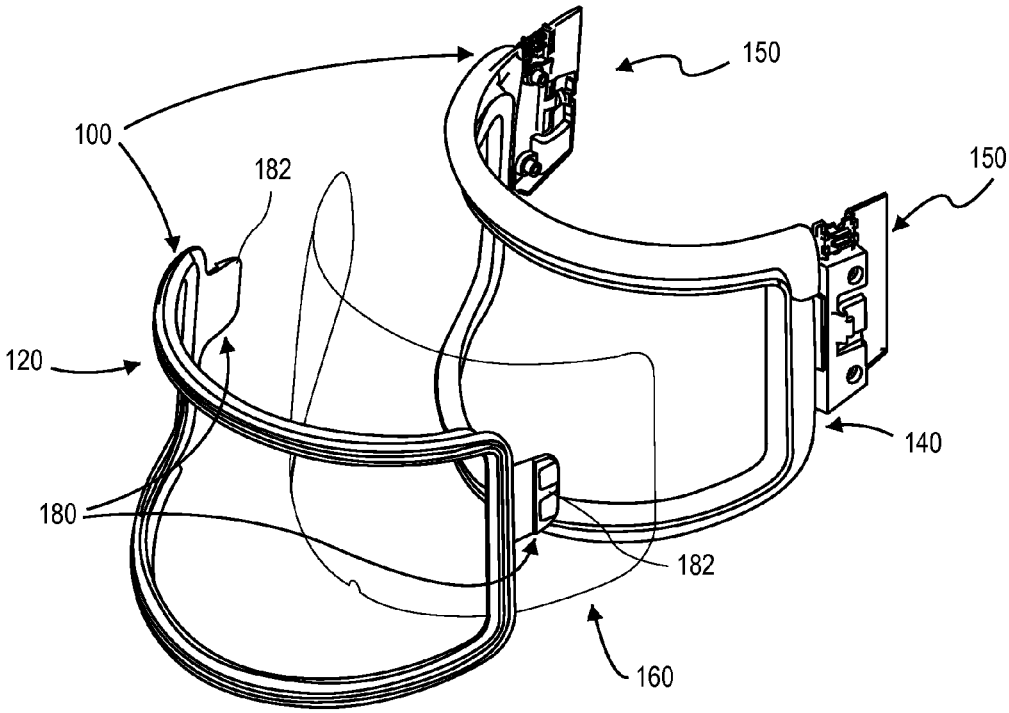
FIGS. 1A-B are diagrams of an exterior view of one embodiment of a lens release mechanism, a lens securing mechanism and a lens.

FIGS. 1A and B are diagrams of an exterior view of one embodiment of a lens release mechanism, a lens securing mechanism and a lens. The lens securing mechanism 100 secures the lens 160 within it and can be coupled to a respirator helmet. The lens securing mechanism 100 defines or is coupled to the lens release mechanism 180. In response to activation of the lens release mechanism 180, the lens release mechanism 180 quickly releases the frame 120 from within the lens securing mechanism 100 and thereby releases the lens 160 from the respirator helmet to which the lens securing mechanism 100 is coupled.

The lens securing mechanism 100 can include a gasket 140. The gasket 140 defines or is coupled to a mounting mechanism 150 to attach the gasket 140 to the respirator helmet through an opening defined by the respirator helmet. The gasket 140 can have any size and shape complementary to the shape and size of the opening defined by the respirator helmet. The gasket 140 defines an opening such that the perimeter of the opening 140 defines a closed or open polygon or ellipse. In one example embodiment, the perimeter of the gasket 140 defines a generally rectangular shape with a height between two and five inches and a width between six to twelve inches. The generally rectangular shape can be flat or curved to conform to the curvature defined by the exterior surface of the respirator helmet. The gasket 140 defines a space to receive the lens 160 including an interior opening and edges around the perimeter of the opening.

The mounting mechanism 150 includes a structure to be attached to the respirator helmet by a set of screws, nuts and bolts or similar fastening devices. A "set" as used herein, refers to any positive whole number of items including one item. The structure of the mounting mechanism 150 can be formed from materials including, but not limited to, plastics (e.g., polyethylene, polycarbonate, polypropylene, polystyrene, or acrylonitrile butadiene styrene), metals (e.g., aluminum, steel, tin, titanium, or chrome), composite compounds (e.g., carbon fiber or fiberglass), and other resilient and lightweight materials. The structure defines a part or whole of an engagement or securing mechanism to removably secure the frame 120 by engaging the lens release mechanism 180. The mounting mechanism 150 can function in conjunction with a groove defined along the edges of the gasket 140 such that the groove follows the perimeter of the gasket 140. The edges of the opening of the respirator helmet can snap into or similarly interlock with the groove and thereby attach the gasket 140 to the respirator helmet by a form fit and create a seal with the respirator helmet. In another embodiment, the gasket 140 or the structure of the mounting mechanism 150 can be integrally formed with respirator helmet.

The lens 160 can be received by a lens securing mechanism 100, including the frame 120, gasket 140 and mounting mechanism 150 and thus attached to the respirator helmet. The lens 160 can be a simple lens providing minimal protections or a non-standard safety lens which is shatter-proof and capable of protecting the eyes of the wearer of the respirator helmet from more significant hazards. The lens 160 can be formed from materials including, but not limited to, shatter-resistant plastics (e.g., polycarbonate) and similar materials of various impact resistance suitable for the construction of a safety lens. The lens 160 can be polarized to protect the eyes of the wearer from ultraviolet light or other harmful radiation or energy sources. The lens 160 can have any size and shape complementary to the shape and size of the opening defined by the gasket 140. In one embodiment, the lens 160 has a generally rectangular shape with a height between two and five inches, a width between six and twelve inches and a thickness between 0.04 and 0.2 inches at the thinnest point. The lens 160 may be flat or curved, depending on the shape of the gasket 140.

The frame 120 in the lens securing mechanism 100 can have any size and shape complementary to the shape and size of the gasket 140. The frame 120 defines an opening such that the perimeter of the opening defines a closed or open polygon or ellipse. In one example embodiment, the perimeter of the frame 120 defines a generally rectangular shape with a height between two and five inches and a width between six to twelve inches. The generally rectangular shape can be flat or curved depending on the shape of the gasket 140. The frame 120 can be removably coupled to the gasket 140 and mounting mechanism 150 and thereby secure the lens 160 within the gasket 140 or between the frame 120 and the gasket 140.

The lens release mechanism 180 can be located at any part of the lens securing mechanism 100. In one example embodiment, the lens release mechanism 180 is a set of push tabs 182 defined by or coupled to the frame 180. The push tab 182 can be extended from the frame 120 or securely coupled to the frame 120. The push tab 182 can be coupled to the frame 120 by a set of screw, nuts and bolts, adhesives or similar fastening devices. The push tab 182 can be positioned along any length the frame 120 adjacent to the mounting mechanism 150. In one embodiment, the push tab 182 and the mounting mechanism 150 are positioned near the midpoint of a vertical edge of the frame 120. The push tab 182 can engage with the mounting mechanism 150. The push tab 182 can be activated by pushing the push tab towards the gasket 140. When the push tab 182 is pushed towards the gasket 140, the push tab 182 disengages from the mounting mechanism 150 and thereby the frame 120 can be pulled away from the gasket 140 and thus from the respiratory helmet. As the frame 120 is pulled away from the gasket 140, the lens 160 is released from the gasket 140.

The push tab 182 can have any shape and size suitable for receiving a manual application of force on it. In one example embodiment, the push tab 182 is a generally rectangular pad with dimensions between one by one and two by two inches and a thickness between 0.08 and 0.2 inches. In another example embodiment, the push tab 182 is a generally cylindrical rod, with a diameter between 0.1 to 0.25 inches and a length between one and two inches.

Figure 1B:
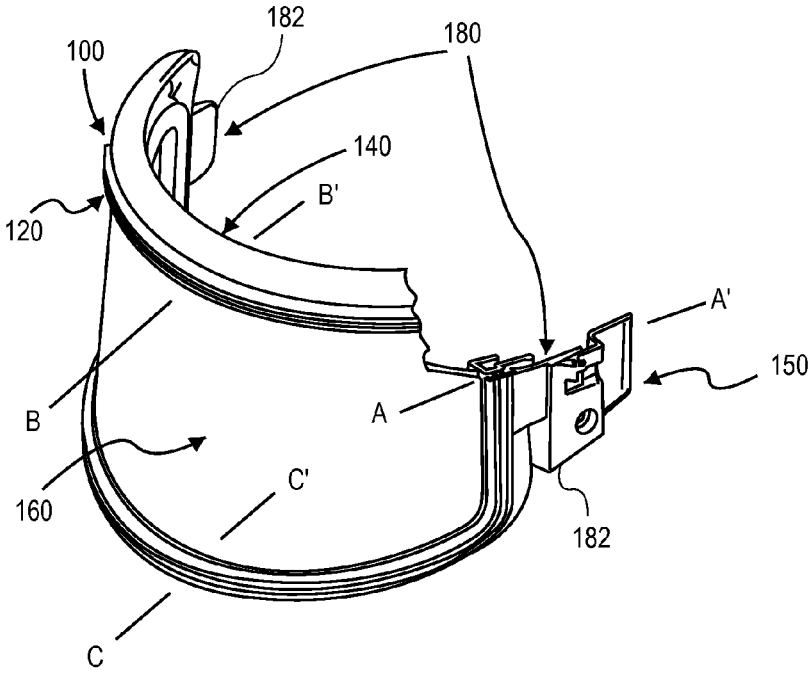
Figure 2A:
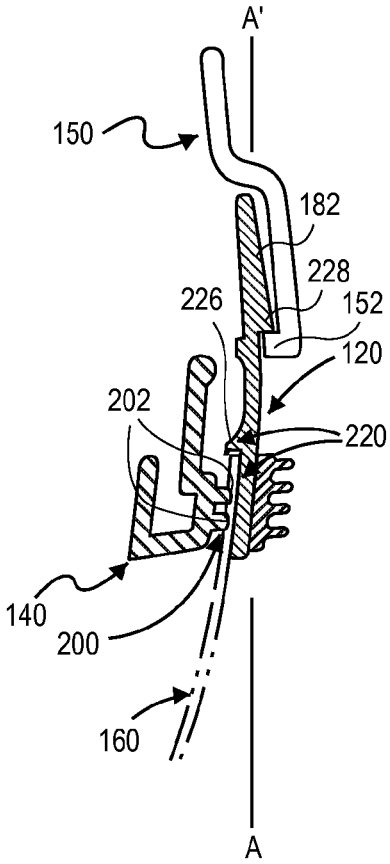
FIGS. 2A-B are diagrams of a cross-sectional view of one embodiment of a lens release mechanism, a lens securing mechanism and a lens.

FIG. 2A is a diagram of a cross-sectional view of one embodiment of a lens release mechanism, a lens securing mechanism and a lens. The diagram illustrates a cross-sectional view of one embodiment, taken along the A-A' line of FIG. 1B. The gasket 140, depicted as an irregular shape with a set of protrusions and indentations, defines a lens seal mechanism 200 to secure the perimeter of the lens 160. In one example embodiment, the lens seal mechanism 200 is a set of ribs 202 defined by gasket 140. The set of ribs 202, depicted as a set of protrusions in the cross-sectional view, runs along and parallel to the edges of the gasket 140 so that it defines a set of closed or open loops on the edges of the gasket 140.

The set of ribs 202 can be in contact with the perimeter of the lens 160. The lens seal mechanism 200, by taking the shape of a set of ribs, minimizes the total area in contact with the lens 160 without overly restricting the lens 160. This allows an easier release of the lens 160 from the gasket 140 when the frame 120 is pulled away from the frame and thereby removing the force holding the lens 160 to the gasket 140. The gasket 140 can be formed from any one of a natural rubber material or a thermoplastic elastomer to provide flexibility and elasticity necessary to form a tight seal with the lens 160.

The portion of the rib 202 that protrudes can have an elliptical or polygonal cross-sectional shape from the gasket 160. The rib 202 can have a length corresponding to the length of the perimeter of the gasket 140. In one example embodiment, the rib 202 has a generally rectangular shape with a height and a length between 0.04 to 0.25 inches. The ribs 202 can be spaced at every 0.04 to 0.2 inches.

The frame 120 is depicted in the cross sectional view as an irregular shape with a set of protrusions and indentations. The frame 120 is engaged with the mounting mechanism 150. In one embodiment, the bank 228 of the push tab 182, depicted as a tip in the cross-sectional view, is engaged with the bank 152 of the mounting mechanism 150, depicted as a squared tip in the cross-sectional view, and thereby the frame 120 is attached to the respiratory helmet. The frame 120 defines a portion of lens retention mechanism 220. A bank 226 is depicted as a triangular tip in the cross-sectional view. In one example embodiment, the lens retention mechanism 220 includes a bank 226 and the surface of the gasket 120 that is in contact with the perimeter of the lens 160. Like the set of ribs 202 of the gasket 140, the bank 226 runs along and parallel to the edges of the frame 140 so that it defines a set of closed or open loops on the edges of the frame 210. The gasket 120 pushes the lens 160 towards the gasket 140 while the frame 120 is attached to the gasket 140, and thereby secures the perimeter of the lens 160 between the gasket 140 and the frame 120. The frame 120 can be formed from any one of a natural rubber material or a thermoplastic elastomer to provide flexibility and elasticity necessary to form a tight seal with the lens 160.

The lens seal mechanism 200 of the gasket 140 and the lens retention mechanism 220 of the frame 120 form a hermetic seal with the perimeter of the lens so that air does not flow between the gasket 140 and the lens 160. For example, the bank 206 holds the edge of the lens 160. The surface of the frame 120 in contact with the perimeter of the lens 160 pushes the perimeter of the lens 160 towards the set of ribs 202. And thereby the bank 226 and the surface create a seal defined by the set of ribs 202 and the perimeter of the lens 140 in contact with the set of ribs 202.

Figure 2B:
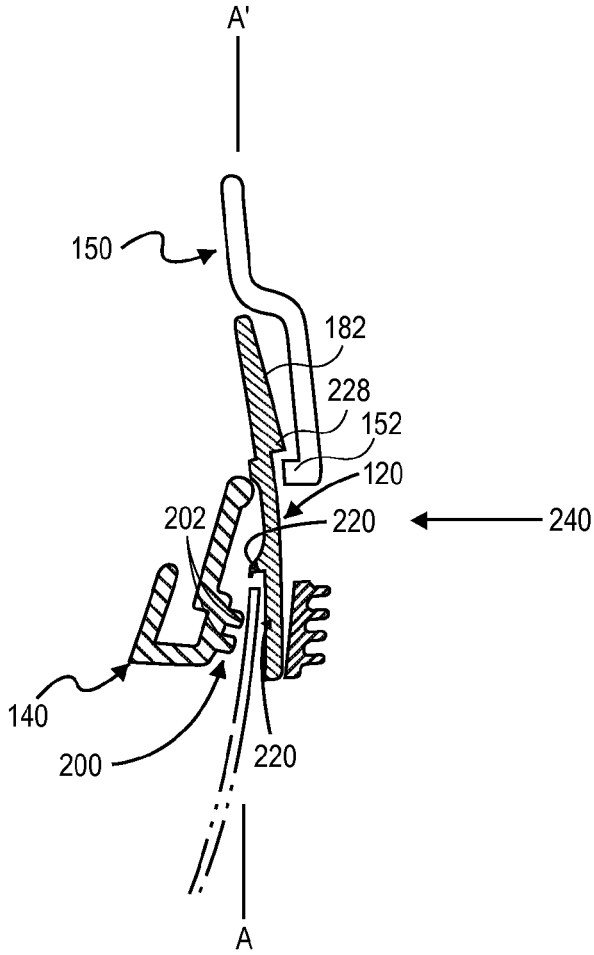

FIG. 2B is a diagram of a cross-sectional view of one embodiment of a lens release mechanism, a lens securing mechanism and a lens. The diagram illustrates a cross-sectional view of one embodiment, taken along the A-A' line of FIG. 1B. The push tab 182 as described above is pushed on the surface between the bank 228 and the bank 220 towards the gasket 140 in the direction of the arrow 240. When the push tab 182 is moved towards the gasket 140, the push tab 182 disengages from the mounting mechanism 150 and thereby the frame 120 can be quickly pulled away from the gasket 140 and from the respiratory helmet. As the frame 120 is pulled away from the gasket 140, the lens 160 is quickly released from the gasket 140.

FIGS. 3A-C are diagrams of a cross-sectional view of one embodiment of a lens release mechanism, a lens securing mechanism and a lens. In one example embodiment, a lens seal mechanism 300 includes the set of ribs 202 as described above and a groove 302, depicted as an indentation in the cross-sectional view, defined by gasket 140. Like the set of ribs 202, a groove 140 runs along and parallel to the edges of the gasket 140 so that it defines a closed or open loop on the edges of the gasket 140. The lens retention mechanism 220 of the frame 120 as described above and the lens seal mechanism 300 of the gasket 140 have complementary interlocking structure. For example, the bank 226 and the groove 302 each have a portion of their boundary closely aligned one another so that the bank 226 and the groove 302 are interlocked to each other in a form fit to attach the frame 120 to the gasket 140 and securing the lens 160 between the gasket 140 and the frame 120. When the lens release mechanism is activated, the frame 120 can be quickly pulled away from the gasket 140. Then the force pushing the frame 120 towards the gasket 140 is removed and thereby the bank 226 is released from the groove 302 and the lens 160 is released from the lens retention mechanism 220 quickly.

Figure 4:
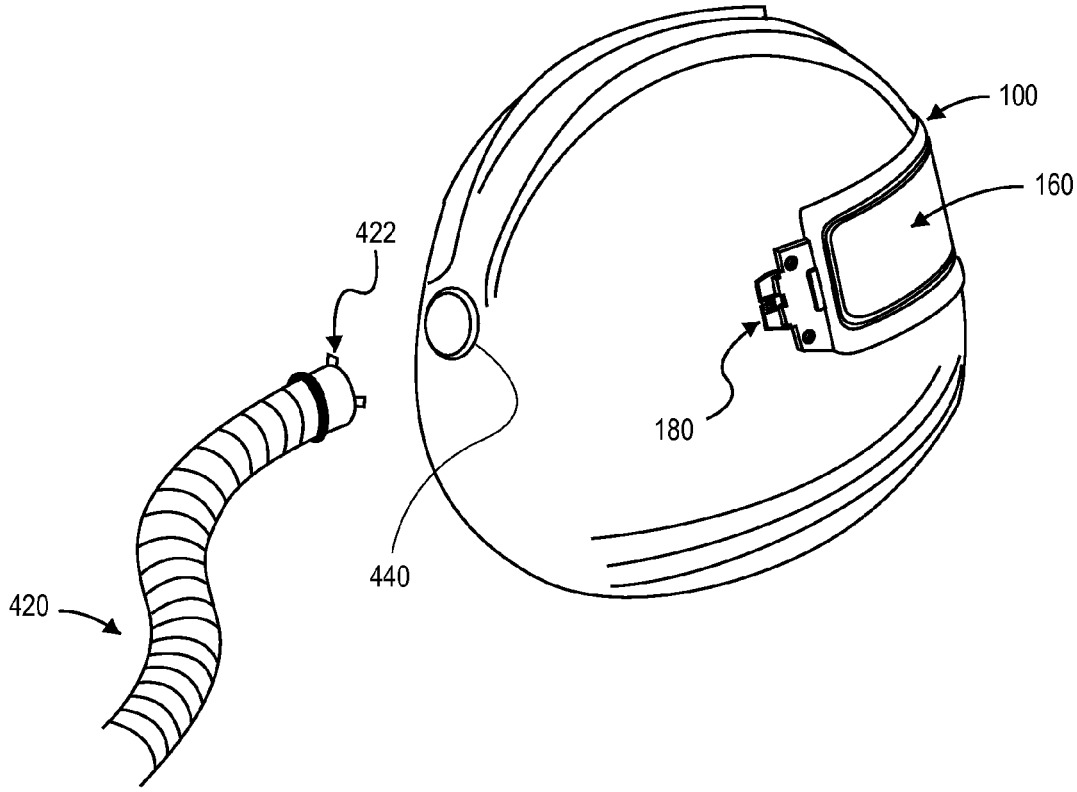
FIG. 4 is a diagram of an exterior view of one embodiment of a lens release mechanism, a lens securing mechanism, a lens and an attachment mechanism.

FIG. 4 is a diagram of an exterior view of one embodiment of a lens release mechanism, a lens securing mechanism, a lens and an attachment mechanism. The respirator helmet 400 is configured with the lens securing mechanism 100 mounted to it. The lens 160 is attached to the respirator helmet 400 by the lens securing mechanism 100.

The respirator helmet 400 shields the head of the wearer of the respirator helmet 400 against harm from falling or flying objects. The respirator helmet 400 in combination with the lens 160 and the lens securing mechanism 100 also shields the wearer from particulate matter and similar environmental hazards. The respirator helmet is capable of releasing the lens 160 quickly using the lens release mechanism 180.

The respirator helmet 400 can be formed wholly or partially of materials including, but not limited to, plastics (e.g., polyethylene, polycarbonate, polypropylene, polystyrene, or acrylonitrile butadiene styrene), metals (e.g., aluminum, steel, tin, titanium, or chrome), composite compounds (e.g., carbon fiber or fiberglass), and other resilient and lightweight materials. The respirator helmet 400 can have any size and shape to form a compartment to receive a human head. In one embodiment, the respirator helmet 400 has a roughly cylindrical shape with a closed top and open bottom, with a height between ten and fifteen inches and width and/or depth or diameter between six to eight inches. In one embodiment, the respirator helmet 400 covers the head of the wearer completely. In another embodiment, the respirator helmet 400 encloses the head of the wearer partially such that portions of the head are exposed. For example, the respirator helmet 400 may expose the face of the wearer.

An attachment mechanism 440 is coupled to the respirator helmet 400 to connect the respirator helmet to an external air supply. A hose 420 is connected to an external air supply. In one example embodiment, the attachment mechanism 440 includes a circular port that receives an end portion 422 of the hose 420 to supply air into the respirator helmet 100 from the external air supply. The air supply to the respirator generates a positive atmosphere within the helmet to further shield the wearer from particulate matters and similar environmental hazards.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a lens;

a gasket removably coupled to the lens, the gasket to form a seal with a respirator helmet the seal formed, by surface contact between the lens and a plurality of ribs defined by the gasket; and a frame removably coupled to the respirator helmet, the frame to secure the lens within the gasket, the frame defining a release mechanism to enable a quick release of the frame from the respirator helmet.

2. The apparatus of claim 1, wherein the lens is a safety lens.

3. The apparatus of claim 1, wherein the respirator helmet defines an internal space to receive positive atmospheric pressure from the external air supply.

4. The apparatus of claim 1, wherein the release mechanism releases the frame from the respiratory helmet in response to activation of the release mechanism.

5. The apparatus of claim 1, wherein the release mechanism includes any one of a push tab, a latch, a button release mechanism, a clip or a snap release.

6. The apparatus of claim 1, wherein the lens, the gasket, the frame and a mounting mechanism collectively form a quick release lens assembly that is hermetically sealed.

7. The apparatus of claim 1, wherein the frame and the gasket have complementary interlocking structures.

8. The apparatus of claim 1, wherein the gasket is formed from any one of a natural rubber material or a thermoplastic elastomer.

9. An apparatus comprising:

a lens;

a respirator helmet;

an attachment mechanism coupled to the a respirator helmet, the attachment mechanism to connect the a respirator helmet to an external air supply;

a lens securing mechanism coupled to the a respirator helmet, the lens securing mechanism to secure the lens within the lens securing mechanism, the lens securing mechanism including a gasket to receive the lens, the gasket coupled to the respirator helmet by a mounting mechanism; and a frame removably coupled to the gasket, the frame to secure the lens within the gasket, the frame coupled to the mounting mechanism wherein the gasket and the frame respectively define a complementary interlocking structure; and a lens release mechanism coupled to the lens securing mechanism, the lens release mechanism to enable a quick release of the lens from the lens securing mechanism.

10. The apparatus of claim 9, wherein the respirator helmet defines an internal space to receive positive atmospheric pressure from the external air supply.

11. The apparatus of claim 9, wherein the lens release mechanism pivots on the gasket and leverages the frame away from the gasket in response to activation of the lens release mechanism.

12. The apparatus of claim 9, wherein the lens release mechanism includes any one of a push tab, a latch, a button release mechanism, a clip or a snap release.

* * * * *